US007354359B2

(12) United States Patent
Sajima

(10) Patent No.: US 7,354,359 B2
(45) Date of Patent: Apr. 8, 2008

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/205,167

(22) Filed: Aug. 17, 2005

(65) Prior Publication Data

US 2006/0068941 A1 Mar. 30, 2006

(30) Foreign Application Priority Data

Sep. 28, 2004 (JP) ..... 2004-280930

(51) Int. Cl.
*A63B 37/12* (2006.01)

(52) U.S. Cl. ..... 473/383

(58) Field of Classification Search ..... 473/383, 473/384

See application file for complete search history.

(56) References Cited

U.S. PATENT DOCUMENTS 4,787,638 A * 11/1988 Kobayashi ..... 473/383
5,338,039 A 8/1994 Oka et al.
5,536,013 A 7/1996 Pocklington
5,735,757 A 4/1998 Moriyama
6,162,136 A * 12/2000 Aoyama ..... 473/383
6,475,106 B1 * 11/2002 Green et al. ..... 473/383
6,547,678 B2 * 4/2003 Barfield ..... 473/383

FOREIGN PATENT DOCUMENTS

JP 2002-336337 A 11/2002

* cited by examiner

*Primary Examiner*—Raeann Trimiew
(74) *Attorney, Agent, or Firm*—Birch, Stewart, Kolasch & Birch, LLP

(57) ABSTRACT

Golf ball has dimples 8. The dimple 8 has a first curved face S1, a second curved face S2, a third curved face S3, a first edge E1, a second edge E2 and a third edge E3. The second edge E2 and the third edge E3 are disposed concentrically with the first edge E1. The first curved face S1 is ring-shaped. The first curved face S1 is inclined downward from the first edge E1 toward the center of the dimple 8. The second curved face S2 is ring-shaped. The second curved face S2 is inclined upward from the second edge E2 toward the center of the dimple 8. The third curved face S3 is bowl-shaped. The third curved face S3 is inclined downward from the third edge E3 toward the center of the dimple 8. The air that flows toward the center of the dimple 8 collides with the third edge E3. Due to this collision, the air flow is disrupted.

7 Claims, 10 Drawing Sheets

(a)

(b)

(a)

(b)

GOLF BALL

CROSS REFERENCE TO RELATED APPLICATIONS

This application claims priority on Patent Application No. 2004-280930 filed in JAPAN on Sep. 28, 2004, the entire contents of which are hereby incorporated by reference.

BACKGROUND OF THE INVENTION

1. Field of the Invention

The present invention relates to golf balls. More particularly, the present invention relates to improvement of dimples of a golf ball.

2. Description of the Related Art

Golf balls have numerous dimples on the surface thereof. The dimples disrupt the air flow around the golf ball during the flight, thereby causing turbulent flow separation. By causing the turbulent flow separation, a separating point of air from the golf ball shifts backwards leading to the reduction of drag. The turbulent flow separation promotes the differentia between the separating points at the upper and lower sides of the golf ball, which results from the backspin, thereby enhancing the lift force that acts upon the golf ball. Such a role of the dimple is referred to as a "dimple effect". Excellent dimples disturb the air flow more efficiently.

A variety of proposals with respect to the dimple shape have been made in an attempt to improve the flight performance. U.S. Pat. No. 5,338,039 discloses a dimple having double slopes. U.S. Pat. No. 5,536,013 discloses a dimple having a projection at the center. U.S. Pat. No. 5,735,757 discloses a dimple having a double radius shape. JP-A No. 2002-336337 discloses a dimple having a sub-dimple formed inside thereof.

Top concern to golf players for golf balls is the travel distance. In light of elevation of the travel distance, there remains room for improvement of the dimple. An object of the present invention is to provide a golf ball that is excellent in the flight performance.

SUMMARY OF THE INVENTION

The golf ball according to the present invention has numerous dimples with a contour being circular, on the surface thereof. This dimple has a first curved face, a second curved face, a third curved face, a circular first edge that is a boundary between a land and the first curved face, a circular second edge that is a boundary between the first curved face and the second curved face, and a circular third edge that is a boundary between the second curved face and the third curved face. The second edge and the third edge are disposed concentrically with the first edge. According to this golf ball, the air flow is disrupted by the edge formed inside of the dimple. This golf ball is excellent in the flight performance.

Preferably, the first curved face is inclined downward toward the dimple center; the second curved face is inclined upward toward the dimple center; and the third curved face is inclined downward toward the dimple center.

Preferably, the dimple further has a fourth curved face, and a fourth edge that is a boundary between the third curved face and the fourth curved face. This fourth edge is disposed concentrically with the first edge.

Preferably, the dimple further has a fifth curved face, and a fifth edge that is a boundary between the fourth curved face and the fifth curved face. This fifth edge is disposed concentrically with the first edge.

Preferably, the dimple further has a sixth curved face, and a sixth edge that is a boundary between the fifth curved face and the sixth curved face. This sixth edge is disposed concentrically with the first edge.

Preferably, the dimple further has a seventh curved face, and a seventh edge that is a boundary between the sixth curved face and the seventh curved face. This seventh edge is disposed concentrically with the first edge.

Preferably, all the curved faces included in the dimple are not protruded upward from the plane including the first edge. Preferably, the first curved face makes a part of a phantom spherical surface, and is inclined downward toward the dimple center. All the curved faces included in the dimple are not protruded downward from this phantom spherical surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus are not limitative of the present invention, and wherein:

BRIEF DESCRIPTION OF THE DRAWINGS

FIG. 4(*b*) is an enlarged cross-sectional view illustrating a part of the golf ball shown in FIG. 1;

FIG. 5(*b*) is a cross-sectional view illustrating the golf ball shown in FIG. 5(*a*);

FIG. 6(*b*) is a cross-sectional view illustrating the golf ball shown in FIG. 6(*a*);

FIG. 7(*b*) is a cross-sectional view illustrating the golf ball shown in FIG. 7(*a*);

FIG. 8(*b*) is a cross-sectional view illustrating the golf ball shown in FIG. 8(*a*);

FIG. 9(*b*) is a cross-sectional view illustrating the golf ball shown in FIG. 9(*a*);

FIG. 10(*b*) is a cross-sectional view illustrating the golf ball shown in FIG. 10(*a*).

DESCRIPTION OF THE PREFERRED EMBODIMENTS

The present invention is hereinafter described in detail with appropriate references to the accompanying drawing according to the preferred embodiments of the present invention.

Figure 1:
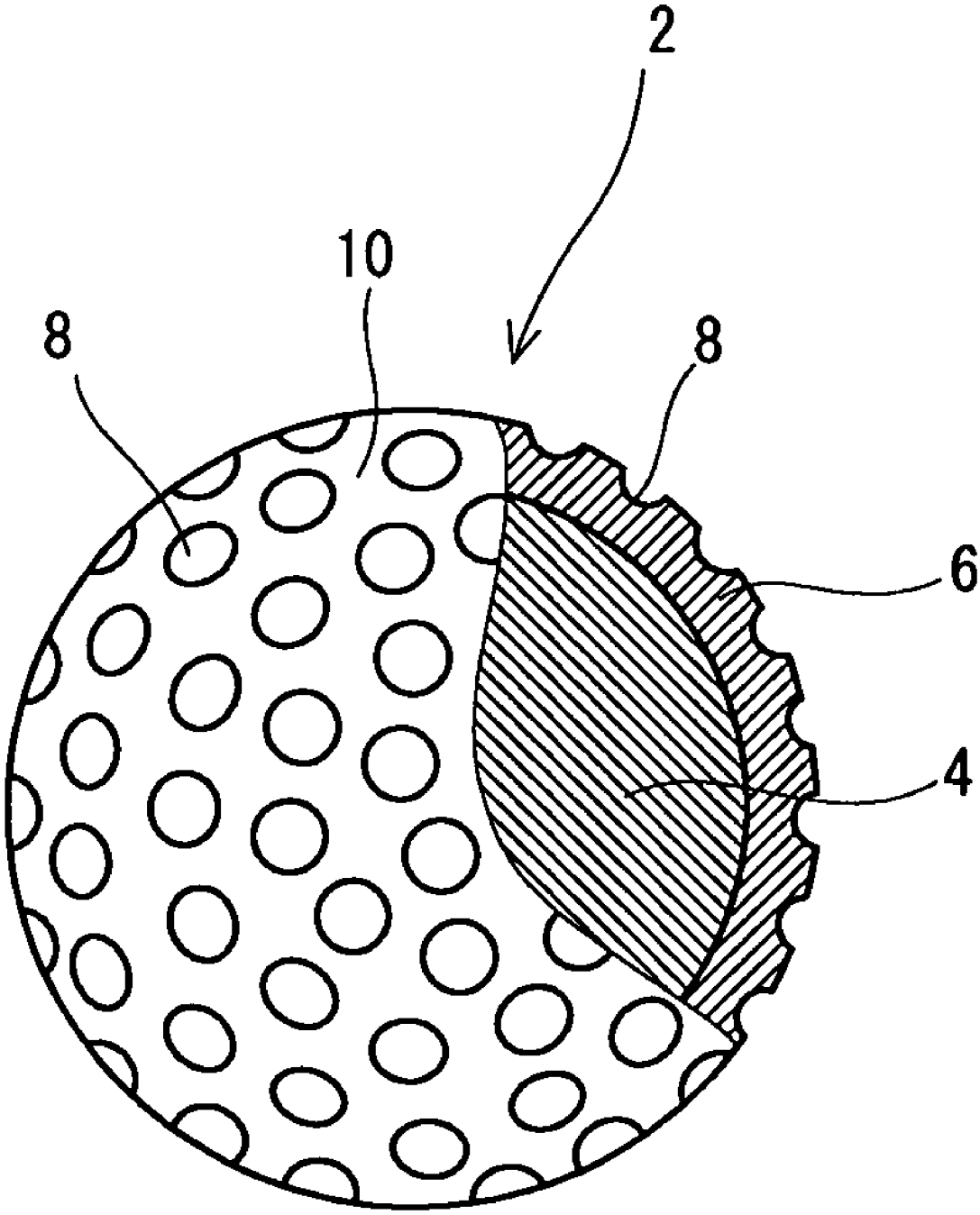
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, a part except for the dimples 8 is a land 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by the United States Golf Association (USGA), the diameter is preferably equal to or greater than 42.67 mm. In light of suppression of the air resistance, the diameter is preferably equal to or less than 44 mm, and more preferably equal to or less than 42.80 mm. The weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by the USGA, the weight is preferably equal to or less than 45.93 g.

The core 4 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high-cis polybutadienes are preferred.

For crosslinking of the core 4, a co-crosslinking agent is usually used. Preferable examples of the co-crosslinking agent in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended at an appropriate amount into the rubber composition of the core 4 as needed. Crosslinked rubber powder or synthetic resin powder may be also blended into the rubber composition.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers.

Polymer that is suitable for the cover 6 is an ionomer rein. In particular, a copolymer of α-olefin and an α,β-unsaturated carboxylic acid having 3 to 8 carbon atoms in which a part of the carboxylic acid is neutralized with a metal ion is suitable. Examples of preferable α-olefin include ethylene and propylene. Examples of preferable α,β-unsaturated carboxylic acid include acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, examples of suitable metal ion include sodium ion, zinc ion, lithium ion and magnesium ion.

Other polymers may be used in place of or together with the ionomer resin. Illustrative examples of the other polymers include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be also blended with powder of a highly dense metal such as tungsten, molybdenum or the like for the purpose of adjusting the specific gravity.

The cover 6 has a thickness of equal to or greater than 0.2 mm, and particularly equal to or greater than 0.8 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
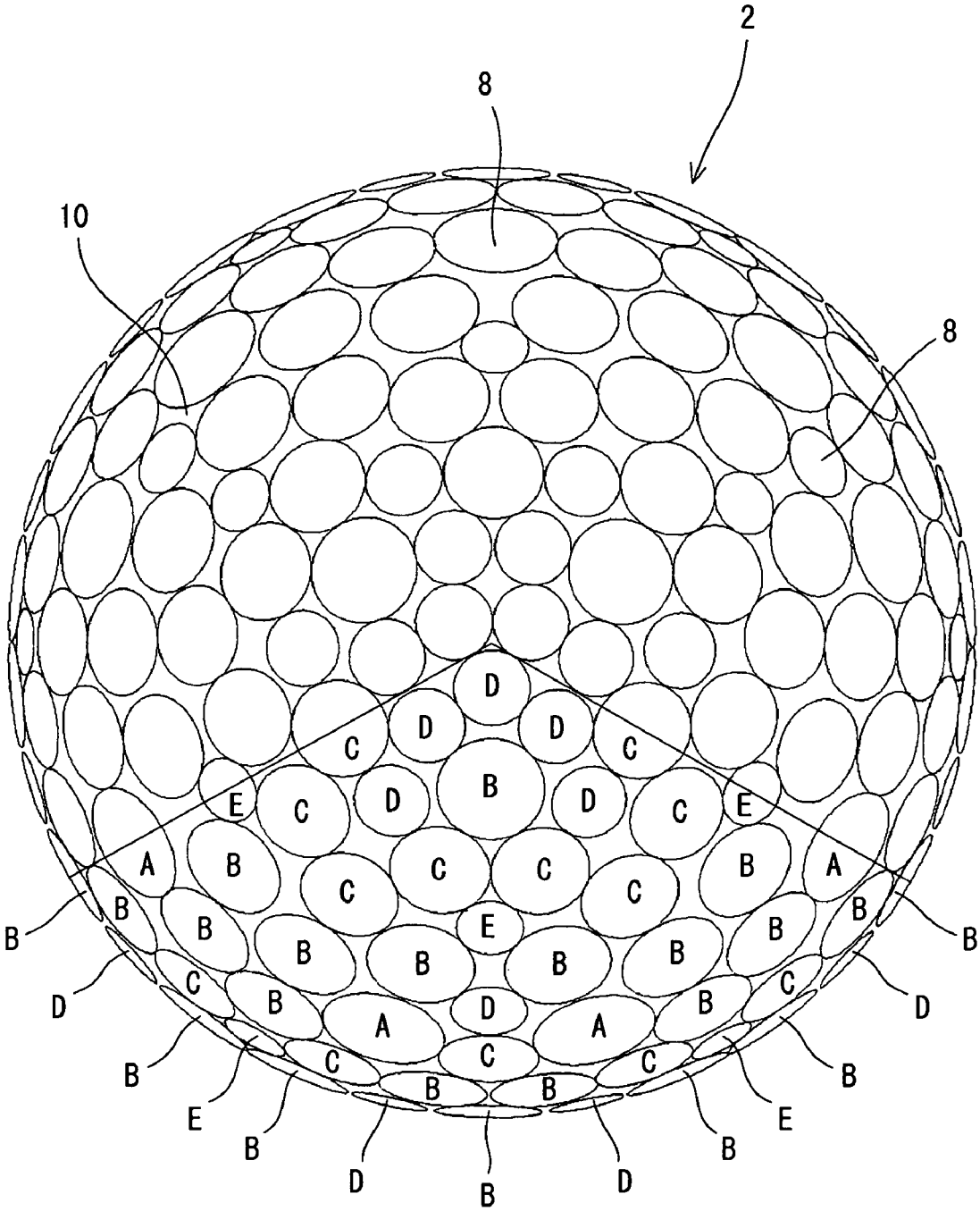
FIG. 2 is an enlarged plan view illustrating the golf ball shown in FIG. 1.
Figure 3:
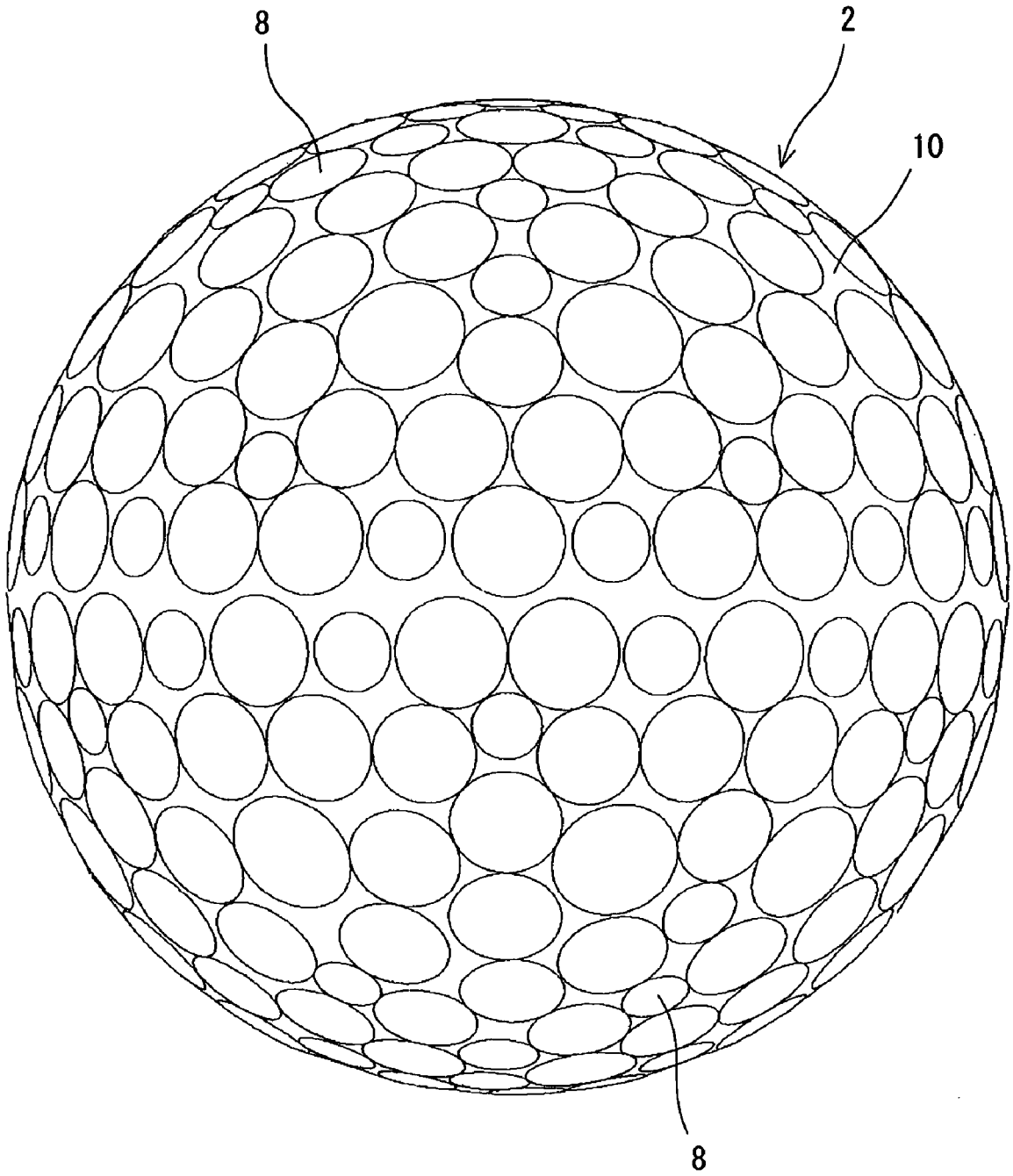
FIG. 3 is a front view illustrating the golf ball shown in FIG. 2.

FIG. 2 is an enlarged plan view illustrating the golf ball 2 shown in FIG. 1; and FIG. 3 is a front view illustrating the golf ball 2 shown in FIG. 2. As is clear from FIG. 2 and FIG. 3, the contour shape of all the dimples 8 is circular. In FIG. 2, types of the dimples 8 are illustrated by symbols of A to E in one unit, provided when the surface of the golf ball 2 is comparted into six equivalent units. This golf ball 2 has dimples A having a diameter of 5.50 mm, dimples B having a diameter of 4.80 mm, dimples C having a diameter of 4.46 mm, dimples D having a diameter of 3.40 mm and dimples E having a diameter of 3.00 mm.

In the golf ball 2 shown in FIG. 2 and FIG. 3, the number of the dimples A is 18; the number of the dimples B is 126; the number of the dimples C is 72; the number of the dimples D is 60; and the number of the dimples E is 24. Total number of the dimples 8 of this golf ball 2 is 300.

Figure 4:
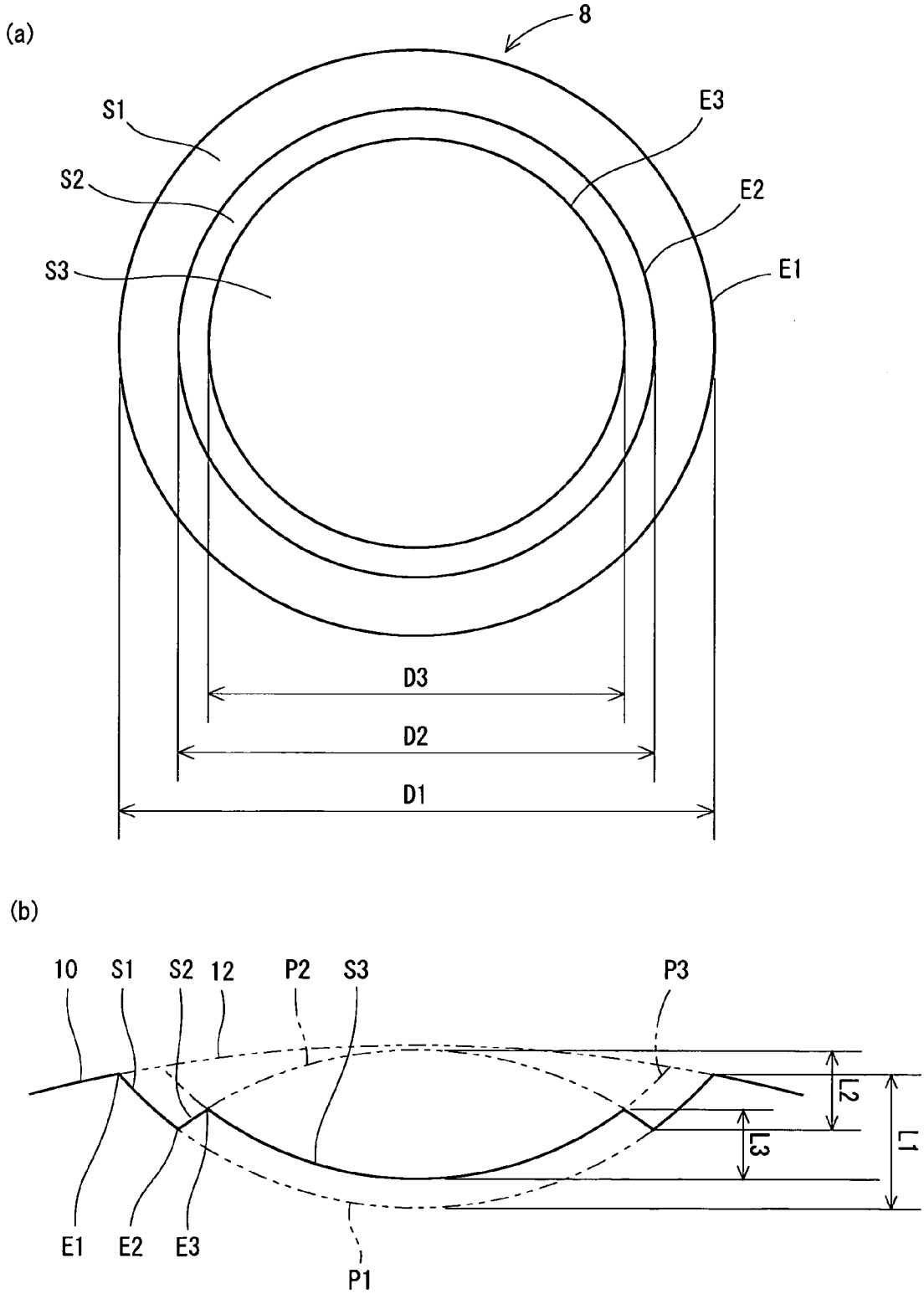
FIG. 4(*a*) is an enlarged plan view illustrating a part of the golf ball shown in FIG. 1.

FIG. 4(*a*) is an enlarged plan view illustrating a part of the golf ball 2 shown in FIG. 1; and FIG. 4(*b*) is an enlarged cross-sectional view illustrating a part of the golf ball 2 shown in FIG. 1. In this FIG. 4(*b*), a cross section along a plane passing through the deepest site of the dimple 8 and the center of the golf ball 2 is shown. A top-to-bottom direction in FIG. 4(*b*) is an in-depth direction. What is indicated by a chain double-dashed line 12 in FIG. 4(*b*) is a ball phantom sphere 12. The surface of the ball phantom sphere 12 corresponds to a surface of the golf ball 2 when it is postulated that there is no dimple 8 existed. The dimple 8 is recessed from the ball phantom sphere 12. The land 10 agrees with the ball phantom sphere 12.

The dimple 8 has a first curved face S1, a second curved face S2, a third curved face S3, a first edge E1, a second edge E2 and a third edge E3. The first edge E1 is a boundary between the land 10 and the first curved face S1. The second edge E2 is a boundary between the first curved face S1 and the second curved face S2. The third edge E3 is a boundary between the second curved face S2 and the third curved face S3. The first edge E1, the second edge E2 and the third edge E3 are circular. As is clear from FIG. 4(*a*), the second edge E2 and the third edge E3 are disposed concentrically with the first edge E1.

The first curved face S1 makes a part of a first phantom spherical surface P1. The first curved face S1 is convex downward. The first curved face S1 is ring-shaped. The first curved face S1 is inclined downward from the first edge E1 toward the center of the dimple 8. The second curved face S2 makes a part of a second phantom spherical surface P2. The second curved face S2 is convex upward. The second curved face S2 is ring-shaped. The second curved face S2 is inclined upward from the second edge E2 toward the center of the dimple 8. The third curved face S3 makes a part of a third phantom spherical surface P3. The third curved face S3 is convex downward. The third curved face S3 is bowl-shaped. The third curved face S3 is inclined downward from the third edge E3 toward the center of the dimple 8.

According to this dimple 8, the air that flows toward the center of the dimple 8 collides with the third edge E3. Due to this collision, the air flow is disrupted. According to the golf ball 2 having this type of dimple 8, the drag is suppressed. This golf ball 2 is excellent in the flight performance.

In this dimple 8, the first curved face S1, the second curved face S2 and the third curved face S3 are not protruded upward from the plane including the first edge E1. In addition, the first curved face S1, the second curved face S2 and the third curved face S3 are not protruded downward from the first phantom spherical surface P1. According to this dimple 8, the air in a sufficient amount flows in toward the center thereof. This dimple 8 is responsible for the flight performance.

In FIG. 4(*a*), what is indicated by a two-headed arrow D1 is the diameter of the first edge E1; what is indicated by a two-headed arrow D2 is the diameter of the second edge E2; and what is indicated by a two-headed arrow D3 is the diameter of the third edge E3. The diameter D1 is also a diameter of the dimple 8. The diameter D1 is greater than the diameter D2. The diameter D2 is greater than diameter D3.

What is indicated by a two-headed arrow L1 in FIG. 4(*b*) is the depth of the first phantom spherical surface P1. Herein, the depth L1 is defined as a distance between the plane including the first edge E1 and the deepest point of the first phantom spherical surface P1. What is indicated by a two-headed arrow L2 in FIG. 4(*b*) is the height of the second phantom spherical surface P2. Herein, the height L2 is defined as a distance between the plane including the second edge E2 and the top of the second phantom spherical surface P2. What is indicated by a two-headed arrow L3 in FIG. 4(*b*) is the depth of the third phantom spherical surface P3. Herein, the depth L3 is defined as a distance between the plane including the third edge E3 and the deepest point of the third phantom spherical surface P3. In light of possible air flow in a sufficient amount toward the center of the dimple 8, it is preferred that the height L2 is smaller than the depth L1, and the depth L3 is smaller than the depth L1.

The dimple 8 has three circular edges E1, E2 and E3. The golf ball 2 may also have other dimple in addition to the dimple 8 having three or more circular edges. In this instance, proportion of the number of the dimples 8 having three or more circular edges to total number of the dimples is preferably equal to or greater than 50%, and more preferably equal to or greater than 70%. Ideally, this proportion is 100%.

In light of the dimple effect, the diameter D1 of the dimple 8 is preferably equal to or greater than 2.0 mm, more preferably equal to or greater than 2.2 mm, and particularly preferably equal to or greater than 2.4 mm. In light of possibility in keeping a fundamental feature of the golf ball 2 which is substantially a sphere, the diameter D1 is preferably equal to or less than 6.0 mm, more preferably equal to or less than 5.8 mm, and particularly preferably equal to or less than 5.6 mm.

When the total number of the dimples 8 is too small, the dimple effect is hardly achieved. In light of the dimple effect, the total number is preferably equal to or greater than 200, more preferably equal to or greater than 240, and particularly preferably equal to or greater than 260. When the total number is too large, the dimple effect is hardly achieved due to small size of the individual dimples 8. In light of the dimple effect, the total number is preferably equal to or less than 500, more preferably equal to or less than 480, and particularly preferably equal to or less than 460.

Herein, the term "dimple volume" means a volume of a part surrounded by a plane including the contour of the dimple 8, and the surface of the dimple 8. In light of suppression of hopping trajectory, total volume of the dimples 8 is preferably equal to or greater than 250 $mm^3$, more preferably equal to or greater than 260 $mm^3$, and particularly preferably equal to or greater than 270 $mm^3$. In light of suppression of dropping trajectory, the total volume is preferably equal to or less than 400 $mm^3$, more preferably equal to or less than 390 $mm^3$, and particularly preferably equal to or less than 380 $mm^3$.

In the present invention, ratio of total area of all the dimples 8 occupying the surface area of the ball phantom sphere is referred to as occupation ratio. In light of achievement of sufficient dimple effect, the occupation ratio is preferably equal to or greater than 75%, more preferably equal to or greater than 77%, and particularly preferably equal to or greater than 79%. The occupation ratio is preferably equal to or less than 90%.

Figure 5:
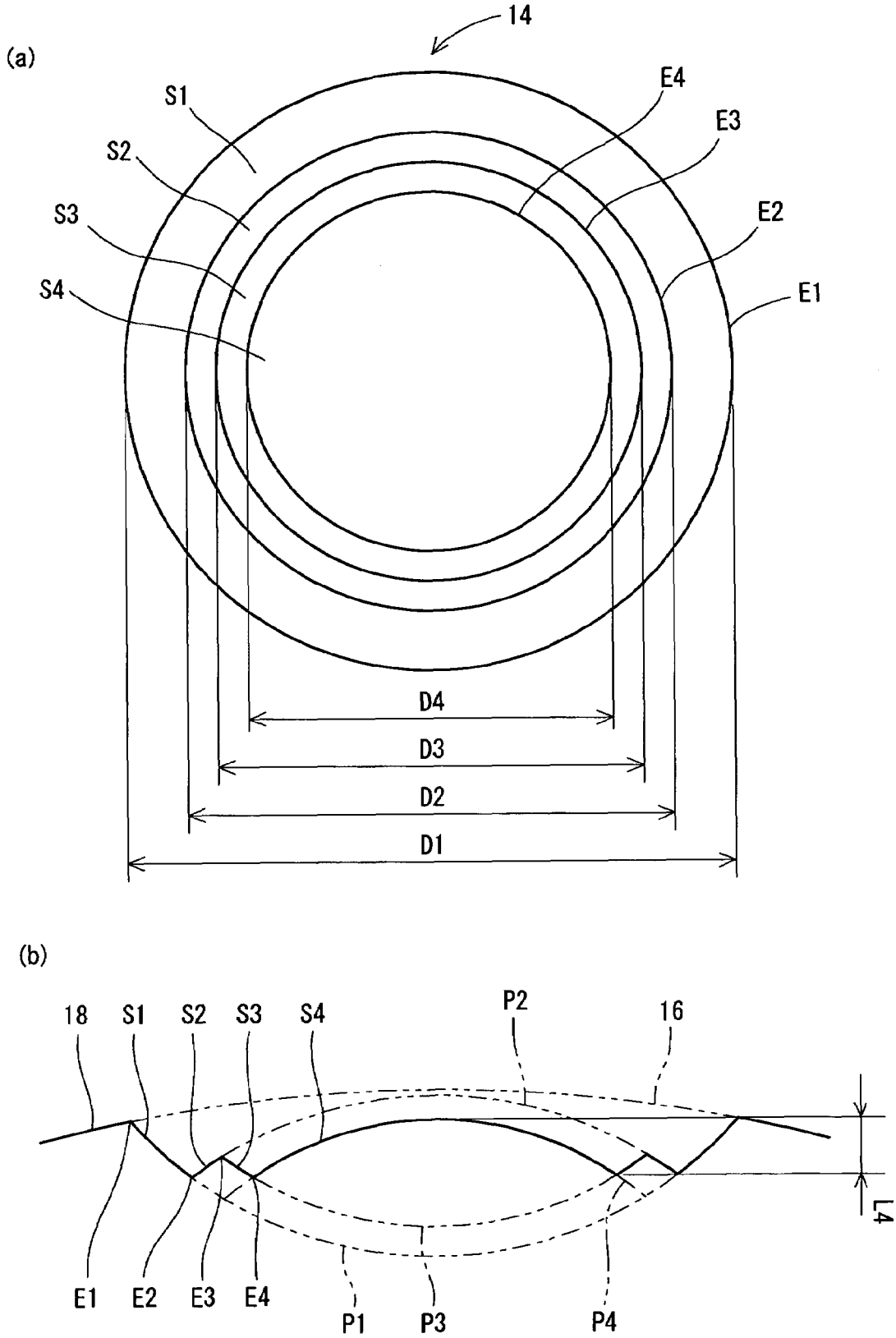
FIG. 5(*a*) a plan view illustrating a part of a golf ball according to another embodiment of the present invention.

FIG. 5(*a*) is a plan view illustrating a part of a golf ball according to another embodiment of the present invention; and FIG. 5(*b*) is a cross-sectional view of the same. In this FIG. 5, a dimple 14 is depicted. What is indicated by a chain double-dashed line 16 in FIG. 5(*b*) is a ball phantom sphere.

This dimple 14 has a first curved face S1, a second curved face S2, a third curved face S3, a fourth curved face S4, a first edge E1, a second edge E2, a third edge E3 and a fourth edge E4. The first edge E1 is a boundary between a land 18 and the first curved face S1. The second edge E2 is a boundary between the first curved face S1 and the second curved face S2. The third edge E3 is a boundary between the second curved face S2 and the third curved face S3. The fourth edge E4 is a boundary between the third curved face S3 and the fourth curved face S4. The first edge E1, the second edge E2, the third edge E3 and the fourth edge E4 are circular. As is clear from FIG. 5(*a*), the second edge E2, the third edge E3 and the fourth edge E4 are disposed concentrically with the first edge E1.

The first curved face S1 makes a part of a first phantom spherical surface P1. The first curved face S1 is convex downward. The first curved face S1 is ring-shaped. The first curved face S1 is inclined downward from the first edge E1 toward the center of the dimple 14. The second curved face S2 makes a part of a second phantom spherical surface P2. The second curved face S2 is convex upward. The second curved face S2 is ring-shaped. The second curved face S2 is inclined upward from the second edge E2 toward the center of the dimple 14. The third curved face S3 makes a part of a third phantom spherical surface P3. The third curved face S3 is convex downward. The third curved face S3 is ring-shaped. The third curved face S3 is inclined downward from the third edge E3 toward the center of the dimple 14. The fourth curved face S4 makes a part of a fourth phantom spherical surface P4. The fourth curved face S4 is convex upward. The fourth curved face S4 is hill-shaped. The fourth curved face S4 is inclined upward from the fourth edge E4 toward the center of the dimple 14.

According to this dimple 14, the air that flows toward the center of the dimple 14 collides with the third edge E3 and the fourth curved face S4. Due to this collision, the air flow is disrupted. According to the golf ball having this type of dimple 14, the drag is suppressed. This golf ball is excellent in the flight performance.

In this dimple 14, the first curved face S1, the second curved face S2, the third curved face S3 and the fourth curved face S4 are not protruded upward from the plane including the first edge E1. In addition, the first curved face S1, the second curved face S2, the third curved face S3 and the fourth curved face S4 are not protruded downward from the first phantom spherical surface P1. According to this dimple 14, the air in a sufficient amount flows in toward the center thereof. This dimple 14 is responsible for the flight performance.

In FIG. 5(*a*), what is indicated by a two-headed arrow D1 is the diameter of the first edge E1; what is indicated by a two-headed arrow D2 is the diameter of the second edge E2; what is indicated by a two-headed arrow D3 is the diameter of the third edge E3; what is indicated by a two-headed arrow D4 is the diameter of the fourth edge E4. The diameter D1 is greater than the diameter D2. The diameter D2 is greater than the diameter D3. The diameter D3 is greater than the diameter D4.

What is indicated by a two-headed arrow L4 in FIG. 5(*b*) is the height of the fourth phantom spherical surface P4. Herein, the height L4 is defined as a distance between the plane including the fourth edge E4 and the top of the fourth phantom spherical surface P4. In light of possible air flow in a sufficient amount toward the center of the dimple 14, it is preferred that the height L4 is smaller than the depth L1 (see, FIG. 4).

Figure 6:
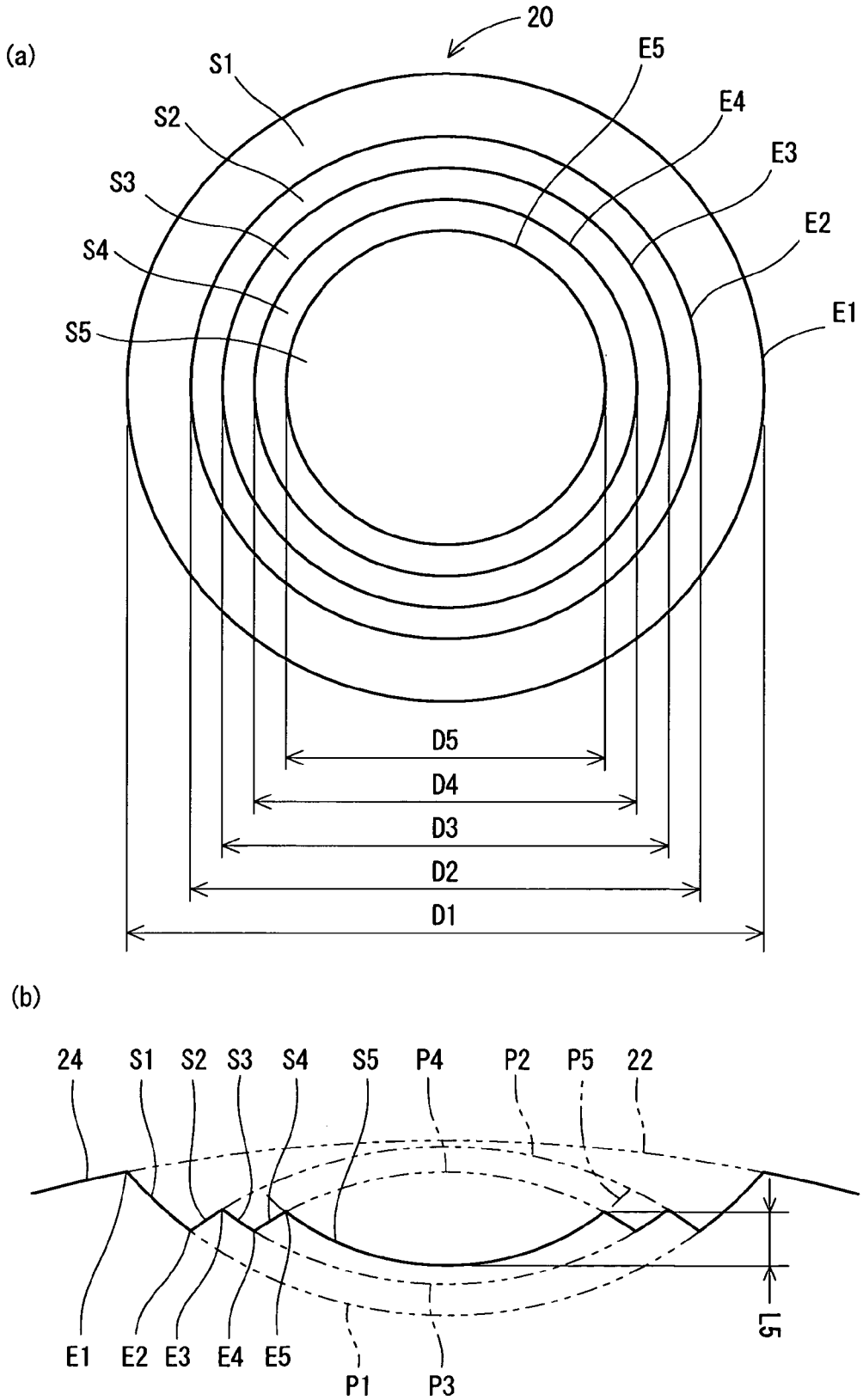
FIG. 6(*a*) is a plan view illustrating a part of a golf ball according to still another embodiment of the present invention.

FIG. 6(*a*) is a plan view illustrating a part of a golf ball according to still another embodiment of the present invention; and FIG. 6(*b*) is a cross-sectional view of the same. In this FIG. 6, a dimple 20 is depicted. What is indicated by a chain double-dashed line 22 in FIG. 6(*b*) is a ball phantom sphere.

This dimple 20 has a first curved face S1, a second curved face S2, a third curved face S3, a fourth curved face S4, a fifth curved face S5, a first edge E1, a second edge E2, a third edge E3, a fourth edge E4 and a fifth edge E5. The first edge E1 is a boundary between a land 24 and the first curved face S1. The second edge E2 is a boundary between the first curved face S1 and the second curved face S2. The third edge E3 is a boundary between the second curved face S2 and the third curved face S3. The fourth edge E4 is a boundary between the third curved face S3 and the fourth curved face S4. The fifth edge E5 is a boundary between the fourth curved face S4 and the fifth curved face S5. The first edge E1, the second edge E2, the third edge E3, the fourth edge E4 and the fifth edge E5 are circular. As is clear from FIG. 6(*a*), the second edge E2, the third edge E3, the fourth edge E4 and the fifth edge E5 are disposed concentrically with the first edge E1.

The first curved face S1 makes a part of a first phantom spherical surface P1. The first curved face S1 is convex downward. The first curved face S1 is ring-shaped. The first curved face S1 is inclined downward from the first edge E1 toward the center of the dimple 20. The second curved face S2 makes a part of a second phantom spherical surface P2. The second curved face S2 is convex upward. The second curved face S2 is ring-shaped. The second curved face S2 is inclined upward from the second edge E2 toward the center of the dimple 20. The third curved face S3 makes a part of a third phantom spherical surface P3. The third curved face S3 is convex downward. The third curved face S3 is ring-shaped. The third curved face S3 is inclined downward from the third edge E3 toward the center of the dimple 20. The fourth curved face S4 makes a part of a fourth phantom spherical surface P4. The fourth curved face S4 is convex upward. The fourth curved face S4 is ring-shaped. The fourth curved face S4 is inclined upward from the fourth edge E4 toward the center of the dimple 20. The fifth curved face S5 makes a part of a fifth phantom spherical surface P5. The fifth curved face S5 is convex downward. The fifth curved face S5 is bowl-shaped. The fifth curved face S5 is inclined downward from the fifth edge E5 toward the center of the dimple 20.

According to this dimple 20, the air that flows toward the center of the dimple 20 collides with the third edge E3 and the fifth edge E5. Due to this collision, the air flow is disrupted. According to the golf ball having this type of dimple 20, the drag is suppressed. This golf ball is excellent in the flight performance.

In this dimple 20, the first curved face S1, the second curved face S2, the third curved face S3, the fourth curved face S4 and the fifth curved face S5 are not protruded upward from the plane including the first edge E1. In addition, the first curved face S1, the second curved face S2, the third curved face S3, the fourth curved face S4 and the fifth curved face S5 are not protruded downward from the first phantom spherical surface P1. According to this dimple 20, the air in a sufficient amount flows in toward the center thereof. This dimple 20 is responsible for the flight performance.

In FIG. 6(*a*), what is indicated by a two-headed arrow D1 is the diameter of the first edge E1; what is indicated by a two-headed arrow D2 is the diameter of the second edge E2; what is indicated by a two-headed arrow D3 is the diameter of the third edge E3; what is indicated by a two-headed arrow D4 is the diameter of the fourth edge E4; and what is indicated by a two-headed arrow D5 is the diameter of the fifth edge E5. The diameter D1 is greater than the diameter D2. The diameter D2 is greater than the diameter D3. The diameter D3 is greater than the diameter D4. The diameter D4 is greater than the diameter D5.

What is indicated by a two-headed arrow L5 in FIG. 6(*b*) is the depth of the fifth phantom spherical surface P5. Herein, the depth L5 is defined as a distance between the plane including the fifth edge E5 and the deepest point of the fifth phantom spherical surface P5. In light of possible air flow in a sufficient amount toward the center of the dimple 20, it is preferred that the height L5 is smaller than the depth L1 (see, FIG. 4).

Figure 7:
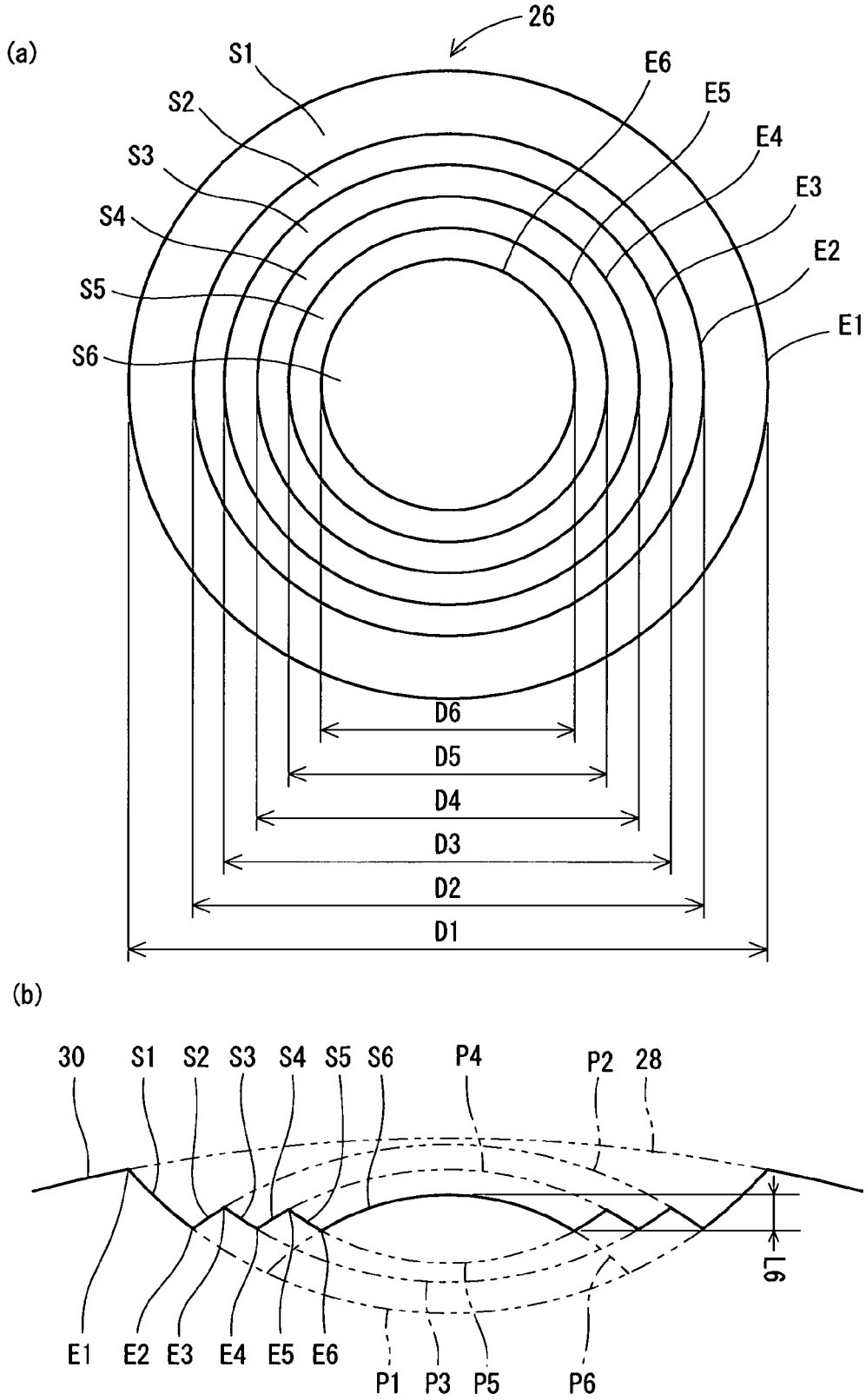
FIG. 7(*a*) is a plan view illustrating a part of a golf ball according to yet another embodiment of the present invention.

FIG. 7(*a*) is a plan view illustrating a part of a golf ball according to yet another embodiment of the present invention; and FIG. 7(*b*) is a cross-sectional view of the same. In this FIG. 7, a dimple 26 is depicted. What is indicated by a chain double-dashed line 28 in FIG. 7(*b*) is a ball phantom sphere.

This dimple 26 has a first curved face S1, a second curved face S2, a third curved face S3, a fourth curved face S4, a fifth curved face S5, a sixth curved face S6, a first edge E1, a second edge E2, a third edge E3, a fourth edge E4, a fifth edge E5 and a sixth edge E6. The first edge E1 is a boundary between a land 30 and the first curved face S1. The second edge E2 is a boundary between the first curved face S1 and the second curved face S2. The third edge E3 is a boundary between the second curved face S2 and the third curved face S3. The fourth edge E4 is a boundary between the third curved face S3 and the fourth curved face S4. The fifth edge E5 is a boundary between the fourth curved face S4 and the fifth curved face S5. The sixth edge E6 is a boundary between the fifth curved face S5 and the sixth curved face S6. The first edge E1, the second edge E2, the third edge E3, the fourth edge E4, the fifth edge E5 and the sixth edge E6 are circular. As is clear from FIG. 7(*a*), the second edge E2, the third edge E3, the fourth edge E4, the fifth edge E5 and the sixth edge E6 are disposed concentrically with the first edge E1.

The first curved face S1 makes a part of a first phantom spherical surface P1. The first curved face S1 is convex downward. The first curved face S1 is ring-shaped. The first curved face S1 is inclined downward from the first edge E1 toward the center of the dimple 26. The second curved face S2 makes a part of a second phantom spherical surface P2. The second curved face S2 is convex upward. The second curved face S2 is ring-shaped. The second curved face S2 is inclined upward from the second edge E2 toward the center of the dimple 26. The third curved face S3 makes a part of a third phantom spherical surface P3. The third curved face S3 is convex downward. The third curved face S3 is ring-shaped. The third curved face S3 is inclined downward from the third edge E3 toward the center of the dimple 26. The fourth curved face S4 makes a part of a fourth phantom spherical surface P4. The fourth curved face S4 is convex upward. The fourth curved face S4 is ring-shaped. The fourth curved face S4 is inclined upward from the fourth edge E4 toward the center of the dimple 26. The fifth curved face S5 makes a part of a fifth phantom spherical surface P5. The fifth curved face S5 is convex downward. The fifth curved face S5 is ring-shaped. The fifth curved face S5 is inclined downward from the fifth edge E5 toward the center of the dimple 26. The sixth curved face S6 makes a part of a sixth phantom spherical surface P6. The sixth curved face S6 is convex upward. The sixth curved face S6 is hill-shaped. The sixth curved face S6 is inclined upward from the sixth edge E6 toward the center of the dimple 26.

According to this dimple 26, the air that flows toward the center of the dimple 26 collides with the third edge E3, the fifth edge E5 and the sixth curved face S6. Due to this collision, the air flow is disrupted. According to the golf ball having this type of dimple 26, the drag is suppressed. This golf ball is excellent in the flight performance.

In this dimple 26, the first curved face S1, the second curved face S2, the third curved face S3, the fourth curved face S4, the fifth curved face S5 and the sixth curved face S6 are not protruded upward from the plane including the first edge E1. In addition, the first curved face S1, the second curved face S2, the third curved face S3, the fourth curved face S4, the fifth curved face S5 and the sixth curved face S6 are not protruded downward from the first phantom spherical surface P1. According to this dimple 26, the air in a sufficient amount flows in toward the center thereof. This dimple 26 is responsible for the flight performance.

In FIG. 7(*a*), what is indicated by a two-headed arrow D1 is the diameter of the first edge E1; what is indicated by a two-headed arrow D2 is the diameter of the second edge E2; what is indicated by a two-headed arrow D3 is the diameter of the third edge E3; what is indicated by a two-headed arrow D4 is the diameter of the fourth edge E4; what is indicated by a two-headed arrow D5 is the diameter of the fifth edge E5; and what is indicated by a two-headed arrow D6 is the diameter of the sixth edge E6. The diameter D1 is greater than the diameter D2. The diameter D2 is greater than the diameter D3. The diameter D3 is greater than the diameter D4. The diameter D4 is greater than the diameter D5. The diameter D5 is greater than the diameter D6.

What is indicated by a two-headed arrow L6 in FIG. 7(*b*) is the height of the sixth phantom spherical surface P6. Herein, the height L6 is defined as a distance between the plane including the sixth edge E6 and the top of the sixth phantom spherical surface P6. In light of possible air flow in a sufficient amount toward the center of the dimple 26, it is preferred that the height L6 is smaller than the depth L1 (see, FIG. 4).

Figure 8:
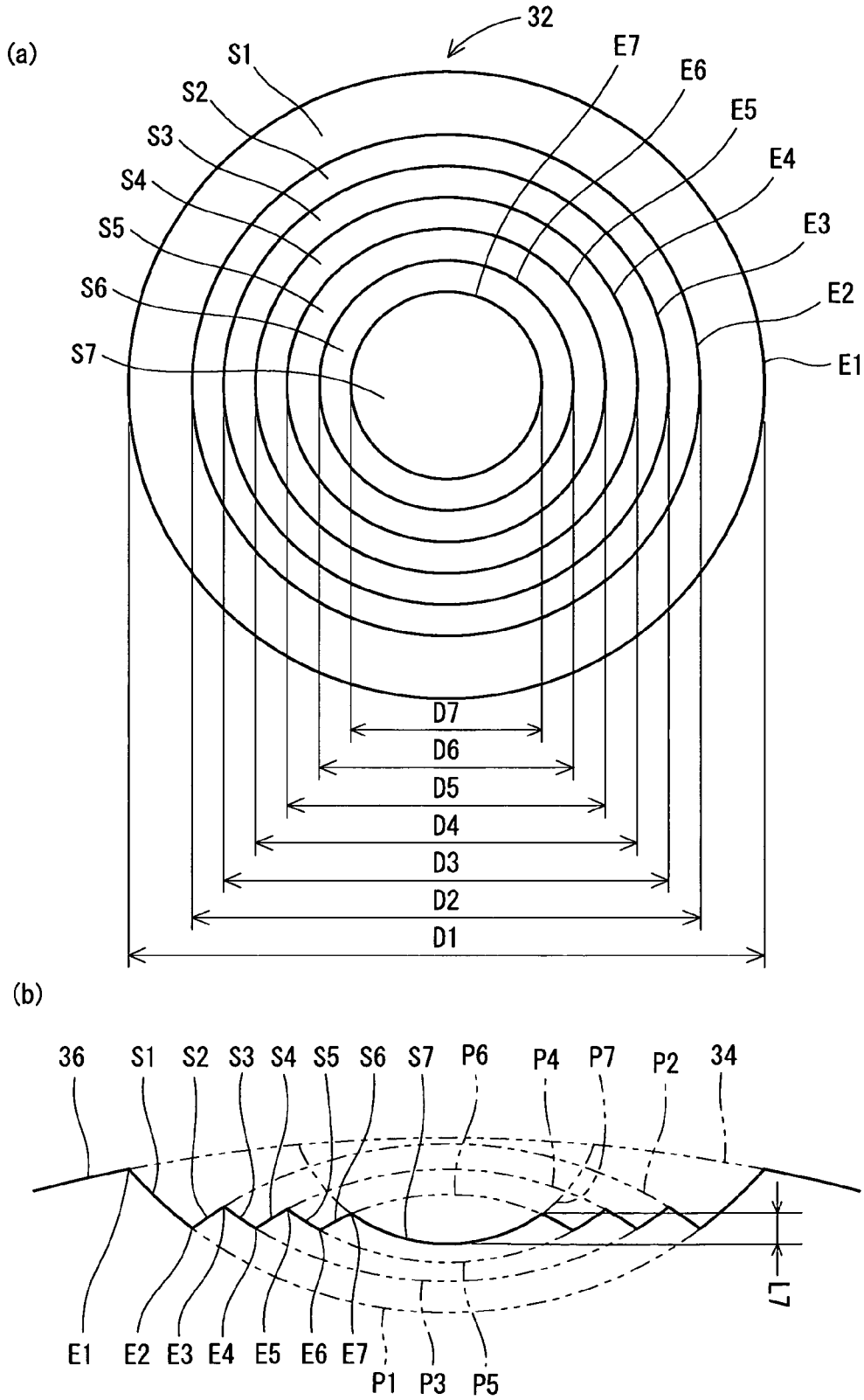
FIG. 8(*a*) is a plan view illustrating a part of a golf ball according to yet another embodiment of the present invention.

FIG. 8(*a*) is a plan view illustrating a part of a golf ball according to yet another embodiment of the present invention; and FIG. 8(*b*) is a cross-sectional view of the same. In this FIG. 8, a dimple 32 is depicted. What is indicated by a chain double-dashed line 34 in FIG. 8(*b*) is a ball phantom sphere.

This dimple 32 has a first curved face S1, a second curved face S2, a third curved face S3, a fourth curved face S4, a fifth curved face S5, a sixth curved face S6, a seventh curved face S7, a first edge E1, a second edge E2, a third edge E3, a fourth edge E4, a fifth edge E5, a sixth edge E6 and a seventh edge E7. The first edge E1 is a boundary between a land 36 and the first curved face S1. The second edge E2 is a boundary between the first curved face S1 and the second curved face S2. The third edge E3 is a boundary between the second curved face S2 and the third curved face S3. The fourth edge E4 is a boundary between the third curved face S3 and the fourth curved face S4. The fifth edge E5 is a boundary between the fourth curved face S4 and the fifth curved face S5. The sixth edge E6 is a boundary between the fifth curved face S5 and the sixth curved face S6. The seventh edge E7 is a boundary between the sixth curved face S6 and the seventh curved face S7. The first edge E1, the second edge E2, the third edge E3, the fourth edge E4, the fifth edge E5, the sixth edge E6 and the seventh edge E7 are circular. As is clear from FIG. 8(*a*), the second edge E2, the third edge E3, the fourth edge E4, the fifth edge E5, the sixth edge E6 and the seventh edge E7 are disposed concentrically with the first edge E1.

The first curved face S1 makes a part of a first phantom spherical surface P1. The first curved face S1 is convex downward. The first curved face S1 is ring-shaped. The first curved face S1 is inclined downward from the first edge E1 toward the center of the dimple 32. The second curved face S2 makes a part of a second phantom spherical surface P2. The second curved face S2 is convex upward. The second curved face S2 is ring-shaped. The second curved face S2 is inclined upward from the second edge E2 toward the center of the dimple 32. The third curved face S3 makes a part of a third phantom spherical surface P3. The third curved face S3 is convex downward. The third curved face S3 is ring-shaped. The third curved face S3 is inclined downward from the third edge E3 toward the center of the dimple 32. The fourth curved face S4 makes a part of a fourth phantom spherical surface P4. The fourth curved face S4 is convex upward. The fourth curved face S4 is ring-shaped. The fourth curved face S4 is inclined upward from the fourth edge E4 toward the center of the dimple 32. The fifth curved face S5 makes a part of a fifth phantom spherical surface P5. The fifth curved face S5 is convex downward. The fifth curved face S5 is ring-shaped. The fifth curved face S5 is inclined downward from the fifth edge E5 toward the center of the dimple 32. The sixth curved face S6 makes a part of a sixth phantom spherical surface P6. The sixth curved face S6 is convex upward. The sixth curved face S6 is ring-shaped. The sixth curved face S6 is inclined upward from the sixth edge E6 toward the center of the dimple 32. The seventh curved face S7 makes a part of a seventh phantom spherical surface P7. The seventh curved face S7 is convex downward. The seventh curved face S7 is bowl-shaped. The seventh curved face S7 is inclined downward from the seventh edge E7 toward the center of the dimple 32.

According to this dimple 32, the air that flows toward the center of the dimple 32 collides with the third edge E3, the fifth edge E5 and the seventh edge E7. Due to this collision, the air flow is disrupted. According to the golf ball having this type of dimple 32, the drag is suppressed. This golf ball is excellent in the flight performance.

In this dimple 32, the first curved face S1, the second curved face S2, the third curved face S3, the fourth curved face S4, the fifth curved face S5, the sixth curved face S6 and the seventh curved face S7 are not protruded upward from the plane including the first edge E1. In addition, the first curved face S1, the second curved face S2, the third curved face S3, the fourth curved face S4, the fifth curved face S5, the sixth curved face S6 and the seventh curved face S7 are not protruded downward from the first phantom spherical surface P1. According to this dimple 32, the air in a sufficient amount flows in toward the center thereof. This dimple 32 is responsible for the flight performance.

In FIG. 8(*a*), what is indicated by a two-headed arrow D1 is the diameter of the first edge E1; what is indicated by a two-headed arrow D2 is the diameter of the second edge E2; what is indicated by a two-headed arrow D3 is the diameter of the third edge E3; what is indicated by a two-headed arrow D4 is the diameter of the fourth edge E4; what is indicated by a two-headed arrow D5 is the diameter of the fifth edge E5; what is indicated by a two-headed arrow D6 is the diameter of the sixth edge E6; and what is indicated by a two-headed arrow D7 is the diameter of the seventh edge E7. The diameter D1 is greater than the diameter D2. The diameter D2 is greater than the diameter D3. The diameter D3 is greater than the diameter D4. The diameter D4 is greater than the diameter D5. The diameter D5 is greater than the diameter D6. The diameter D6 is greater than the diameter D7.

What is indicated by a two-headed arrow L7 in FIG. 8(*b*) is the depth of the seventh phantom spherical surface P7. Herein, the depth L7 is defined as a distance between the plane including the seventh edge E7 and the deepest point of the seventh phantom spherical surface P7. In light of possible air flow in a sufficient amount toward the center of the dimple 32, it is preferred that the depth L7 is smaller than the depth L1 (see, FIG. 4).

EXAMPLES

Example 1

A rubber composition was obtained by kneading 100 parts by weight of polybutadiene (trade name "BR-11", available from JSR Corporation), 24.5 parts by weight of zinc diacrylate, 10 parts of zinc oxide, 15 parts by weight of barium sulfate and 0.8 part by weight of dicumyl peroxide. This rubber composition was placed into a mold having upper and lower mold half each having a hemispherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts of titanium dioxide. The aforementioned core was placed into a mold having numerous pimples on the inner surface, followed by injection of the aforementioned resin composition around the core according to injection molding to form a cover having a thickness of 2.3 mm. Numerous dimples having a shape inverted from the shape of the pimple were formed on the cover. Paint was applied on this cover to give a golf ball of Example 1 having a diameter of 42.7 mm and a weight of about 45.4 g. This golf ball had a compression (ATTI) of about 85. Specifications of the dimples of this golf ball are presented in Table 2 below.

Examples 2 to 4 and Comparative Examples 1 to 2

In a similar manner to Example 1 except that the mold was changed to alter specifications of the dimples as presented in Table 1 to Tale 5 below, golf balls of Examples 2 to 4 and Comparative Examples 1 to 2 were obtained.

TABLE 1

Figure 9:
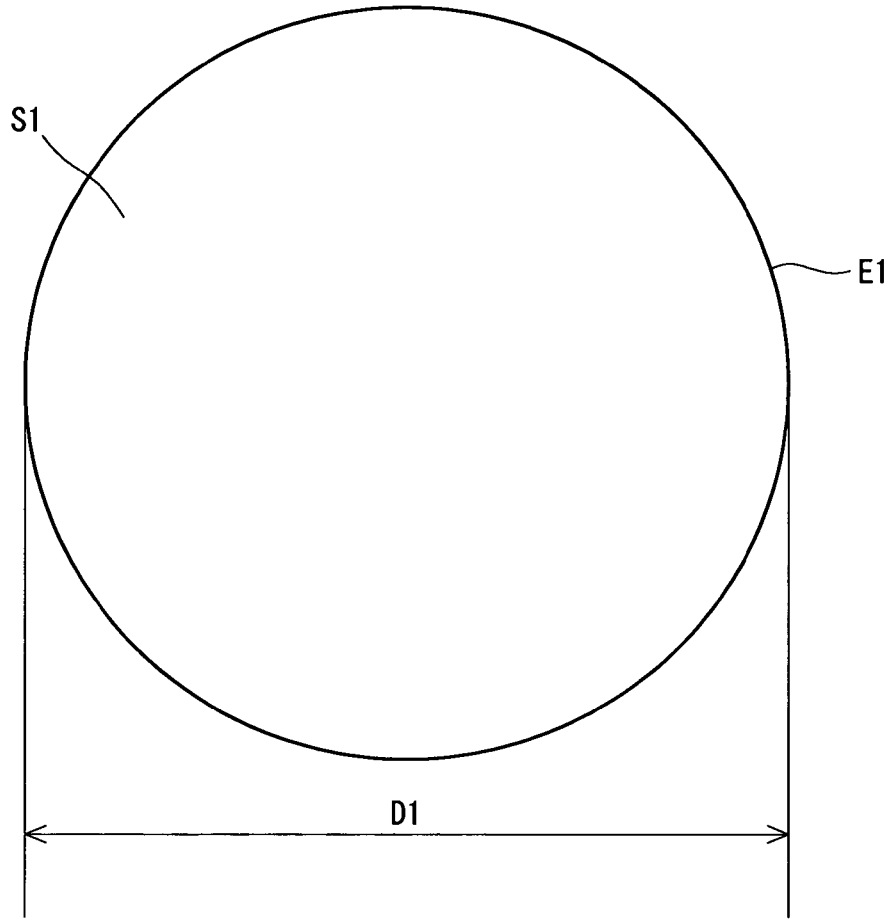
FIG. 9(*a*) is a plan view illustrating a part of a golf ball according to Comparative Example 1.
Figure 9:
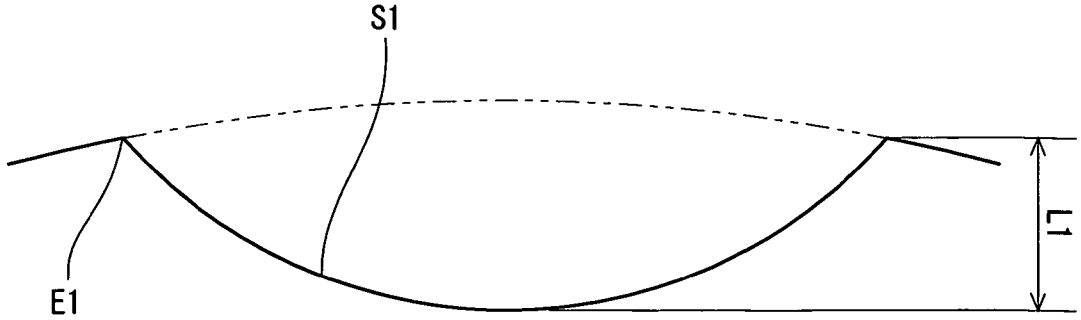
Figure 10:
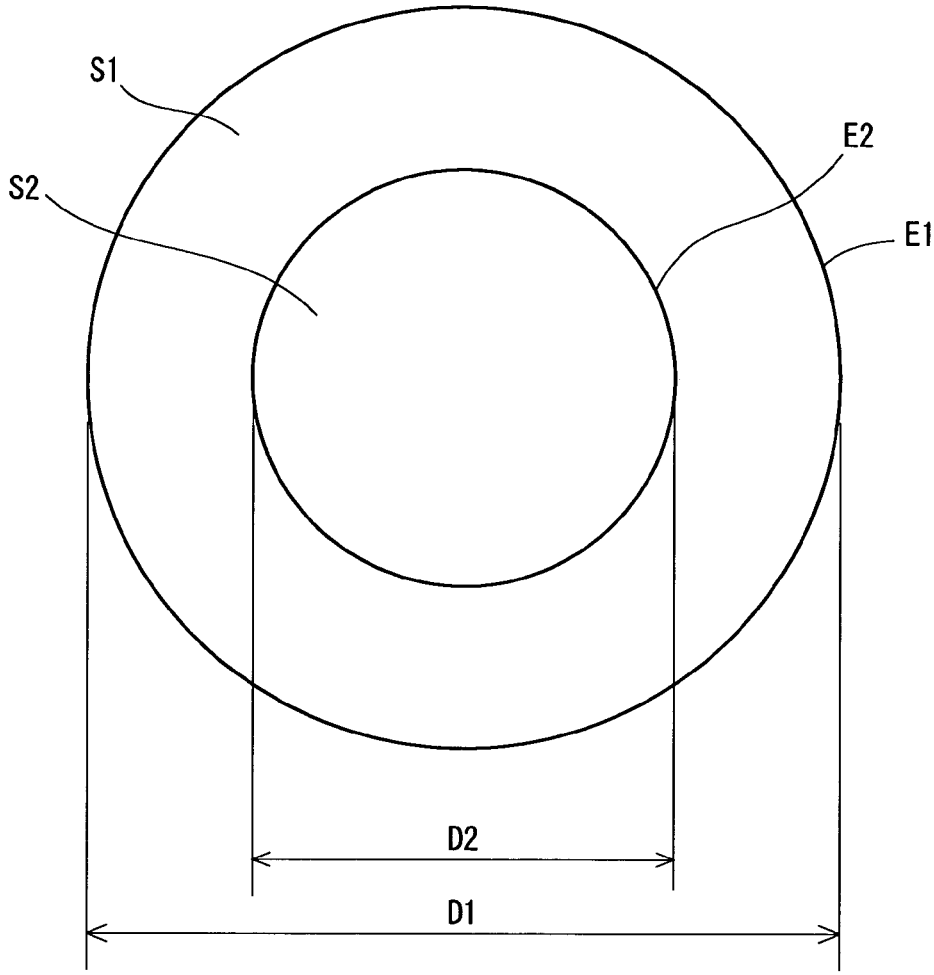
FIG. 10(*a*) is a plan view illustrating a part of a golf ball according to Comparative Example 2.
Figure 10:
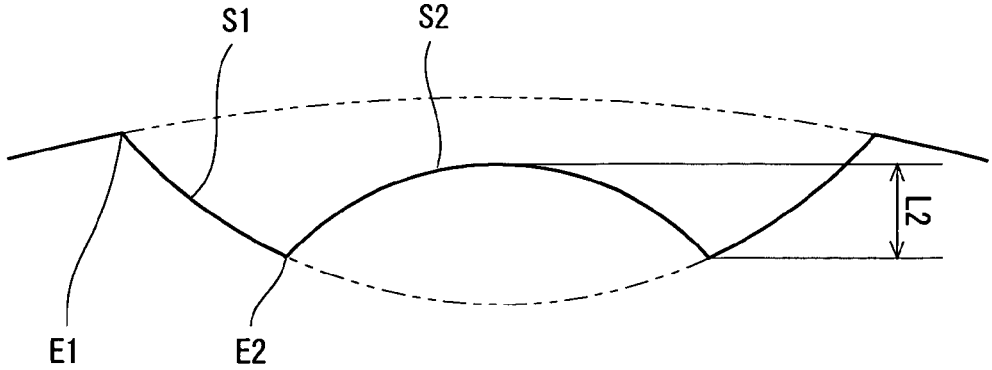

| | | | Specification of dimples | | | | |
|---|---|---|---|---|---|---|---|
| | | | Dimple A | Dimple B | Dimple C | Dimple D | Dimple E |
| Comp. | Number | | 18 | 126 | 72 | 60 | 24 |
| example 1 | First phantom | Diameter D1 (mm) | 5.500 | 4.800 | 4.460 | 3.400 | 3.000 |
| FIG. 9 | spherical | Depth L1 (mm) | 0.1410 | 0.1410 | 0.1400 | 0.1400 | 0.1400 |
| | surface | Curvature (mm) | 26.89 | 20.50 | 17.83 | 10.39 | 8.11 |
| | Volume ($mm^3$) | | 1.676 | 1.277 | 1.095 | 0.637 | 0.496 |
| Comp. | Number | | 18 | 126 | 72 | 60 | 24 |
| example 2 | First phantom | Diameter D1 (mm) | 5.500 | 4.800 | 4.460 | 3.400 | 3.000 |
| FIG. 10 | spherical | Depth L1 (mm) | 0.2240 | 0.2230 | 0.2230 | 0.2210 | 0.2200 |
| | surface | Curvature (mm) | 16.99 | 13.03 | 11.26 | 6.65 | 5.22 |
| | Second phantom | Diameter D2 (mm) | 3.850 | 3.360 | 3.122 | 2.380 | 2.100 |
| | spherical | Height L2 (mm) | 0.0600 | 0.0600 | 0.0600 | 0.0600 | 0.0600 |
| | surface | Curvature (mm) | 30.91 | 23.55 | 20.34 | 11.83 | 9.22 |
| | Volume ($mm^3$) | | 1.680 | 1.274 | 1.101 | 0.636 | 0.494 |

TABLE 2

| | | | Specification of dimples | | | | |
|---|---|---|---|---|---|---|---|
| | | | Dimple A | Dimple B | Dimple C | Dimple D | Dimple E |
| Example 1 | Number | | 18 | 126 | 72 | 60 | 24 |
| FIG. 4 | First phantom | Diameter D1 (mm) | 5.500 | 4.800 | 4.460 | 3.400 | 3.000 |
| | spherical | Depth L1 (mm) | 0.2000 | 0.2000 | 0.2000 | 0.2000 | 0.2000 |
| | surface | Curvature (mm) | 19.01 | 14.50 | 12.53 | 7.33 | 5.73 |
| | Second phantom | Diameter D2 (mm) | 4.400 | 3.840 | 3.568 | 2.720 | 2.400 |
| | spherical | Height L2 (mm) | 0.0700 | 0.0700 | 0.0700 | 0.0700 | 0.0700 |
| | surface | Curvature (mm) | 34.61 | 26.37 | 22.77 | 13.25 | 10.32 |
| | Third phantom | Diameter D3 (mm) | 3.960 | 3.456 | 3.211 | 2.448 | 2.160 |
| | spherical | Depth L3 (mm) | 0.0730 | 0.0730 | 0.0710 | 0.0710 | 0.0710 |
| | surface | Curvature (mm) | 26.89 | 20.49 | 18.19 | 10.59 | 8.25 |
| | Volume ($mm^3$) | | 1.674 | 1.276 | 1.095 | 0.638 | 0.498 |
| Example 2 | Number | | 18 | 126 | 72 | 60 | 24 |
| FIG. 5 | First phantom | Diameter D1 (mm) | 5.500 | 4.800 | 4.460 | 3.400 | 3.000 |
| | spherical | Depth L1 (mm) | 0.2100 | 0.2100 | 0.2100 | 0.2100 | 0.2100 |
| | surface | Curvature (mm) | 18.11 | 13.82 | 11.95 | 6.99 | 5.46 |
| | Second phantom | Diameter D2 (mm) | 4.400 | 3.840 | 3.568 | 2.720 | 2.400 |
| | spherical | Height L2 (mm) | 0.0500 | 0.0500 | 0.0500 | 0.0500 | 0.0500 |
| | surface | Curvature (mm) | 48.43 | 36.89 | 31.85 | 18.52 | 14.43 |
| | Third phantom | Diameter D3 (mm) | 3.960 | 3.456 | 3.211 | 2.448 | 2.160 |
| | spherical | Depth L3 (mm) | 0.1420 | 0.1420 | 0.1420 | 0.1420 | 0.1420 |
| | surface | Curvature (mm) | 13.88 | 10.59 | 9.15 | 5.35 | 4.18 |
| | Fourth phantom | Diameter D4 (mm) | 3.168 | 2.765 | 2.569 | 1.958 | 1.728 |
| | spherical | Height L4 (mm) | 0.0500 | 0.0500 | 0.0500 | 0.0500 | 0.0500 |
| | surface | Curvature (mm) | 25.12 | 19.14 | 16.52 | 9.61 | 7.49 |
| | Volume ($mm^3$) | | 1.669 | 1.273 | 1.100 | 0.642 | 0.502 |

TABLE 3

| | | | Specification of dimples | | | | |
|---|---|---|---|---|---|---|---|
| | | | Dimple A | Dimple B | Dimple C | Dimple D | Dimple E |
| Example 3 | Number | | 18 | 126 | 72 | 60 | 24 |
| FIG. 6 | First phantom | Diameter D1 (mm) | 5.500 | 4.800 | 4.460 | 3.400 | 3.000 |
| | spherical | Depth L1 (mm) | 0.2000 | 0.2000 | 0.2000 | 0.2000 | 0.2000 |
| | surface | Curvature (mm) | 19.01 | 14.50 | 12.53 | 7.33 | 5.73 |
| | Second phantom | Diameter D2 (mm) | 4.400 | 3.840 | 3.568 | 2.720 | 2.400 |
| | spherical | Height L2 (mm) | 0.0700 | 0.0700 | 0.0700 | 0.0700 | 0.0700 |
| | surface | Curvature (mm) | 34.61 | 26.37 | 22.77 | 13.25 | 10.32 |
| | Third phantom | Diameter D3 (mm) | 3.960 | 3.456 | 3.211 | 2.448 | 2.160 |
| | spherical | Depth L3 (mm) | 0.1270 | 0.1270 | 0.1270 | 0.1270 | 0.1270 |
| | surface | Curvature (mm) | 15.50 | 11.82 | 10.21 | 5.96 | 4.66 |
| | Fourth phantom | Diameter D4 (mm) | 3.168 | 2.765 | 2.569 | 1.958 | 1.728 |
| | spherical | Height L4 (mm) | 0.1000 | 0.1000 | 0.1000 | 0.1000 | 0.1000 |
| | surface | Curvature (mm) | 12.60 | 9.61 | 8.30 | 4.84 | 3.78 |
| | Fifth phantom | Diameter D5 (mm) | 2.693 | 2.350 | 2.184 | 1.665 | 1.469 |
| | spherical | Depth L5 (mm) | 0.0600 | 0.0600 | 0.0600 | 0.0600 | 0.0600 |
| | surface | Curvature (mm) | 15.14 | 11.54 | 9.96 | 5.80 | 4.52 |
| | Volume ($mm^3$) | | 1.670 | 1.273 | 1.100 | 0.641 | 0.501 |

TABLE 4

| | | | Specification of dimples | | | | |
|---|---|---|---|---|---|---|---|
| | | | Dimple A | Dimple B | Dimple C | Dimple D | Dimple E |
| Example 4 | Number | | 18 | 126 | 72 | 60 | 24 |
| FIG. 7 | First phantom | Diameter D1 (mm) | 5.500 | 4.800 | 4.460 | 3.400 | 3.000 |
| | spherical | Depth L1 (mm) | 0.2000 | 0.2000 | 0.2000 | 0.2000 | 0.2000 |
| | surface | Curvature (mm) | 19.01 | 14.50 | 12.53 | 7.33 | 5.73 |
| | Second phantom | Diameter D2 (mm) | 4.400 | 3.840 | 3.568 | 2.720 | 2.400 |
| | spherical | Height L2 (mm) | 0.0700 | 0.0700 | 0.0700 | 0.0700 | 0.0700 |
| | surface | Curvature (mm) | 34.61 | 26.37 | 22.77 | 13.25 | 10.32 |
| | Third phantom | Diameter D3 (mm) | 3.960 | 3.456 | 3.211 | 2.448 | 2.160 |
| | spherical | Depth L3 (mm) | 0.1400 | 0.1400 | 0.1400 | 0.1400 | 0.1400 |
| | surface | Curvature (mm) | 14.07 | 10.73 | 9.28 | 5.42 | 4.24 |
| | Fourth phantom | Diameter D4 (mm) | 3.168 | 2.765 | 2.569 | 1.958 | 1.728 |
| | spherical | Height L4 (mm) | 0.0700 | 0.0700 | 0.0700 | 0.0700 | 0.0700 |
| | surface | Curvature (mm) | 17.96 | 13.69 | 11.82 | 6.88 | 5.37 |
| | Fifth phantom | Diameter D5 (mm) | 2.693 | 2.350 | 2.184 | 1.665 | 1.469 |

TABLE 4-continued

| Specification of dimples | | | Dimple A | Dimple B | Dimple C | Dimple D | Dimple E |
|---|---|---|---|---|---|---|---|
| | spherical | Depth L5 (mm) | 0.1050 | 0.1050 | 0.1050 | 0.1050 | 0.1050 |
| | surface | Curvature (mm) | 8.68 | 6.63 | 5.73 | 3.35 | 2.62 |
| | Sixth phantom | Diameter D6 (mm) | 2.154 | 1.880 | 1.747 | 1.332 | 1.175 |
| | spherical | Height L6 (mm) | 0.0660 | 0.0610 | 0.0610 | 0.0600 | 0.0600 |
| | surface | Curvature (mm) | 8.82 | 7.27 | 6.28 | 3.72 | 2.91 |
| | Volume ($mm^3$) | | 1.660 | 1.273 | 1.100 | 0.643 | 0.502 |

TABLE 5

| Specification of dimples | | | Dimple A | Dimple B | Dimple C | Dimple D | Dimple E |
|---|---|---|---|---|---|---|---|
| Example 5 | Number | | 18 | 126 | 72 | 60 | 24 |
| FIG. 8 | First phantom | Diameter D1 (mm) | 5.500 | 4.800 | 4.460 | 3.400 | 3.000 |
| | spherical | Depth L1 (mm) | 0.2000 | 0.2000 | 0.2000 | 0.2000 | 0.2000 |
| | surface | Curvature (mm) | 19.01 | 14.50 | 12.53 | 7.33 | 5.73 |
| | Second phantom | Diameter D2 (mm) | 4.400 | 3.840 | 3.568 | 2.720 | 2.400 |
| | spherical | Height L2 (mm) | 0.0700 | 0.0700 | 0.0700 | 0.0700 | 0.0700 |
| | surface | Curvature (mm) | 34.61 | 26.37 | 22.77 | 13.25 | 10.32 |
| | Third phantom | Diameter D3 (mm) | 3.960 | 3.456 | 3.211 | 2.448 | 2.160 |
| | spherical | Depth L3 (mm) | 0.1400 | 0.1400 | 0.1400 | 0.1400 | 0.1400 |
| | surface | Curvature (mm) | 14.07 | 10.73 | 9.28 | 5.42 | 4.24 |
| | Fourth phantom | Diameter D4 (mm) | 3.168 | 2.765 | 2.569 | 1.958 | 1.728 |
| | spherical | Height L4 (mm) | 0.0700 | 0.0700 | 0.0700 | 0.0700 | 0.0700 |
| | surface | Curvature (mm) | 17.96 | 13.69 | 11.82 | 6.88 | 5.37 |
| | Fifth phantom | Diameter D5 (mm) | 2.693 | 2.350 | 2.184 | 1.665 | 1.469 |
| | spherical | Depth L5 (mm) | 0.0800 | 0.0800 | 0.0800 | 0.0800 | 0.0800 |
| | surface | Curvature (mm) | 11.37 | 8.67 | 7.49 | 4.37 | 3.41 |
| | Sixth phantom | Diameter D6 (mm) | 2.154 | 1.880 | 1.747 | 1.332 | 1.175 |
| | spherical | Height L6 (mm) | 0.0750 | 0.0750 | 0.0750 | 0.0750 | 0.0750 |
| | surface | Curvature (mm) | 7.77 | 5.93 | 5.12 | 2.99 | 2.34 |
| | Seventh phantom | Diameter D7 (mm) | 1.293 | 1.128 | 1.048 | 0.799 | 0.705 |
| | spherical | Depth L7 (mm) | 0.0800 | 0.0800 | 0.0700 | 0.0700 | 0.0700 |
| | surface | Curvature (mm) | 2.65 | 2.03 | 2.00 | 1.18 | 0.92 |
| | Volume ($mm^3$) | | 1.671 | 1.275 | 1.097 | 0.640 | 0.500 |

[Flight Distance Test]

A driver having a metal head (trade name "XXIO", available from Sumitomo Rubber Industries, Ltd.; shaft hardness: X, loft angle: 9°) was attached to a swing machine, available from True Temper Co. Then the golf ball was hit under the condition of the head speed being 49 m/sec, the launch angle being approximately 11° and giving the initial spin rate of approximately 3000 rpm. Accordingly, distance from the launching point to the point where the ball stopped was measured. Under the condition during the test, it was almost windless. Mean values of 20 times measurement are shown in Table 6 below.

TABLE 6

| Results of evaluation | | Compara. example 1 | Compara. example 2 | Example 1 | Example 2 | Example 3 | Example 4 | Example 5 |
|---|---|---|---|---|---|---|---|---|
| Dimple pattern | Plan view | FIG. 2 | FIG. 2 | FIG. 2 | FIG. 2 | FIG. 2 | FIG. 2 | FIG. 2 |
| | Front view | FIG. 3 | FIG. 3 | FIG. 3 | FIG. 3 | FIG. 3 | FIG. 3 | FIG. 3 |
| Cross-sectional shape | | FIG. 9 | FIG. 10 | FIG. 4 | FIG. 5 | FIG. 6 | FIG. 7 | FIG. 8 |
| Total number of dimples | | 300 | 300 | 300 | 300 | 300 | 300 | 300 |
| Total volume ($mm^3$) | | 320.1 | 320.1 | 320.0 | 320.2 | 320.1 | 320.1 | 320.1 |
| Number of ring-shaped curved face | | 0 | 1 | 2 | 3 | 4 | 5 | 6 |
| Number of bowl-shaped curved face | | 1 | 0 | 1 | 0 | 1 | 0 | 1 |
| Number of hill-shaped curved face | | 0 | 1 | 0 | 1 | 0 | 1 | 0 |
| Number of circular edge | | 1 | 2 | 3 | 4 | 5 | 6 | 7 |
| Flight distance (m) | | 237.6 | 238.2 | 239.5 | 240.7 | 241.6 | 242.4 | 243.4 |

As is shown in Table 6, the golf balls of Examples are excellent in the flight performance. Therefore, advantages of the present invention are clearly suggested by these results of evaluation.

The dimples as described hereinabove are suitable for not only two-piece golf balls, but also one-piece golf balls, multi-piece golf balls and wound golf balls. The foregoing description is just for an illustrative example, therefore, various modifications can be made in the scope without departing from the principles of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golf ball having numerous dimples with a contour being circular, on the surface thereof, at least one of said dimples having a first curved face, a second curved face, a third curved face, a circular first edge that is a boundary between a land and the first curved face, a circular second edge that is a boundary between the first curved face and the second curved face, and a circular third edge that is a boundary between the second curved face and the third curved face, the second edge and the third edge being disposed concentrically with the first edge, wherein said first curved face is a concave surface that curves downward toward the dimple center, the second curved face is a convex surface that curves upward toward the dimple center, and the third curved face is a concave surface that curves downward toward the dimple center.

2. The golf ball according to claim 1, wherein said at least one dimple further has a fourth curved face, and a fourth edge that is a boundary between the third curved face and the fourth curved face, said fourth edge being disposed concentrically with the first edge.

3. The golf ball according to claim 2, wherein said at least one dimple further has a fifth curved face, and a fifth edge that is a boundary between the fourth curved face and the fifth curved face, said fifth edge being disposed concentrically with the first edge.

4. The golf ball according to claim 3, wherein said at least one dimple further has a sixth curved face, and a sixth edge that is a boundary between the fifth curved face and the sixth curved face, said sixth edge being disposed concentrically with the first edge.

5. The golf ball according to claim 4, wherein said at least one dimple further has a seventh curved face, and a seventh edge that is a boundary between the sixth curved face and the seventh curved face, said seventh edge being disposed concentrically with the first edge.

6. The golf ball according to claim 1, wherein all the curved faces included in said at least one dimple are not protruded upward from the plane including the first edge.

7. The golf ball according to claim 1, wherein said first curved face makes a part of a phantom spherical surface, and is curved downward toward the dimple center, all the curved faces included in said at least one dimple not being protruded downward from said phantom spherical surface.

* * * * *